US009823040B1

(12) United States Patent
Hu

(10) Patent No.: US 9,823,040 B1
(45) Date of Patent: Nov. 21, 2017

(54) GUN BARREL UNIT FOR A TOY GUN

(71) Applicant: Shih-Che Hu, Tainan (TW)

(72) Inventor: Shih-Che Hu, Tainan (TW)

( * ) Notice: Subject to any disclaimer, the term of this patent is extended or adjusted under 35 U.S.C. 154(b) by 0 days.

(21) Appl. No.: 15/245,135

(22) Filed: Aug. 23, 2016

(51) Int. Cl.

| | |
|---|---|
| ***F41A 21/00*** | (2006.01) |
| ***F41A 21/04*** | (2006.01) |
| ***F41B 11/70*** | (2013.01) |
| ***F41B 11/89*** | (2013.01) |

(52) U.S. Cl.
CPC ..... *F41B 11/70* (2013.01); *F41B 11/89* (2013.01)

(58) Field of Classification Search
CPC ..... F41A 21/00; F41A 21/04; F41A 21/10; F41A 21/08; F41C 27/22; F41F 3/048
USPC ..... 89/14.05; 42/76.01, 77, 78, 97
See application file for complete search history.

(56) References Cited

U.S. PATENT DOCUMENTS 2,699,094 A * 1/1955 Musser ..... F42B 14/02 102/526
3,550,300 A * 12/1970 Roder ..... F41A 21/08 42/106
4,483,235 A * 11/1984 Hallqvist ..... F41A 25/22 89/14.05
H202 H * 2/1987 Geeter ..... 89/14.05
5,097,614 A * 3/1992 Strong ..... F41A 21/28 42/76.01
5,283,970 A * 2/1994 Aigner ..... F41C 3/08 362/112
5,314,125 A * 5/1994 Ohno ..... B02C 17/14 241/175
5,438,785 A * 8/1995 Simon ..... F41A 21/482 42/75.02
RE35,381 E * 11/1996 Rose ..... F41A 21/32 42/97
5,631,437 A * 5/1997 LaVigna et al. ..... F41A 27/30 89/14.05
5,907,921 A * 6/1999 Rose ..... F41C 27/22 42/76.01
6,273,080 B1 * 8/2001 Sullivan, Jr. ..... F41B 11/00 124/73
6,698,128 B2 * 3/2004 Kessler ..... F41A 21/00 124/83
6,874,403 B2 * 4/2005 Strayn ..... F41A 21/48 124/58
8,714,146 B2 * 5/2014 Hu ..... F41A 21/12 124/83
9,052,151 B1 * 6/2015 Tseng ..... F41A 21/00
9,212,861 B2 * 12/2015 Panak ..... F41A 21/36
(Continued)

*Primary Examiner* — Derrick R Morgan
(74) *Attorney, Agent, or Firm* — Raymond Y. Chan; David and Raymond Patent Firm

(57) ABSTRACT

A gun barrel unit for a toy gun includes: an inner barrel and an outer barrel, the inner barrel is axially inserted in the outer barrel, at least one rotary member is provided between the inner and outer barrels to allow for rotation of the inner barrel with respect to the outer barrel, and at least one eccentric weight is fixed in the inner barrel. The inner barrel is pivotable and the inner barrel is provided with the eccentric weight, so that even when the gun is held in an inclined position, the inner barrel still can return to a non-inclined manner to ensure the ballistic trajectory stability when firing. Besides, an engaging assembly is provided at the rear end of the inner barrel, so that the inner barrel can still be fixed to the outer barrel in a fixed manner to facilitate ballistic trajectory adjustment.

5 Claims, 10 Drawing Sheets

(56) References Cited

U.S. PATENT DOCUMENTS

| | | | | |
|---|---|---|---|---|
| 9,435,603 | B2 * | 9/2016 | Choi | F41G 3/12 |
| 9,557,130 | B2 * | 1/2017 | Shneorson | F41A 19/59 |
| 2002/0078616 | A1 * | 6/2002 | Perry | F41A 21/04 42/76.01 |
| 2003/0182838 | A1 * | 10/2003 | Kessler | F41B 11/00 42/79 |
| 2006/0005447 | A1 * | 1/2006 | Lenner | F41G 3/06 42/111 |
| 2012/0272941 | A1 * | 11/2012 | Hu | F41A 21/12 124/83 |
| 2014/0007857 | A1 * | 1/2014 | Schlosser | F41A 21/04 124/81 |
| 2016/0332175 | A1 * | 11/2016 | Fu | B08B 3/028 |
| 2016/0377372 | A1 * | 12/2016 | Hodgson | F41A 21/30 42/1.06 |

* cited by examiner

A-A'

B-B'

GUN BARREL UNIT FOR A TOY GUN

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a gun barrel unit for a toy gun, and more particularly to a gun barrel unit, wherein the inner barrel can always be returned back to the non-inclined position whenever it is rotated, to ensure the ballistic trajectory adjustment function.

Description of Related Arts

The gun barrel unit of a toy gun generally includes an inner barrel and an outer barrel, and the inner barrel is used as a passage for accommodating or firing bullets. Due to the consideration of cost and structure complicity, the inner barrel is not provided with a spiral line (rifling) on the inner surface thereof, which results in non-directional rotation movement of the fired bullet. Therefore, the control of the bullet ballistic trajectory in a toy gun is difficult, and the bullet usually missed the target.

In view of the aforementioned problem, Taiwan Patent Nos. 299663, M298109 and 1416060 disclose the use of a ballistic adjustment device in a toy gun, wherein a flexible bullet barrel is provided at the rear end of the gun barrel, and in the bullet barrel is provided a protruding block. Friction will be generated when the bullet passes through the protruding block, which stabilizes the bullet trajectory.

However, the inner barrels of the gun barrel units of the abovementioned or existing toy guns are all fixed to the outer barrels in a fixed manner. In actual application (such as survival game), the gun is often held in an inclined position due to the restriction of location and user's posture, in this case, the protruding block 201 of the bullet barrel 20 at the rear end of the inner barrel 10 is also inclined (as shown in FIG. 1), the bullet ballistic trajectory is also inclined, which therefore hampers the function of the ballistic adjustment device.

The present invention has arisen to mitigate and/or obviate the afore-described disadvantages.

SUMMARY OF THE PRESENT INVENTION

The present invention is aimed at providing a gun barrel unit for a toy gun, which is capable of overcoming the problem of the conventional toy gun barrel that deviation of the ballistic trajectory will occur when the toy gun is held in an inclined position, causing ballistic trajectory instability and low hit rate.

Therefore, a gun barrel unit for a toy gun in accordance with the present invention comprises: an inner barrel and an outer barrel, the inner barrel is axially inserted in the outer barrel, at least one rotary member is provided between the inner and outer barrels to allow for rotation of the inner barrel with respect to the outer barrel, and at least one eccentric weight is fixed in the inner barrel and located at at least one connecting position. The inner barrel is pivotable and the inner barrel is provided with the eccentric weight, so that even when the gun is held in an inclined position, the inner barrel still can return to a non-inclined manner to ensure the ballistic trajectory stability when firing.

Preferably, the at least one connecting position is at the front, middle or rear of the inner barrel.

Preferably, a ballistic adjustment device is disposed at a rear end of the inner barrel, a slot is provided at an upper surface of the rear end of the inner barrel, the ballistic adjustment device at least includes a bullet barrel, a pressure assembly, and a rotary base, the bullet barrel is an elastic member sleeved onto the rear end of the inner barrel, at least two protruding blocks are formed on an inner surface of the rear end of the bullet barrel and located corresponding to the slot of the inner barrel, the pressure assembly is located on the rear end of the bullet barrel to press the protruding blocks, the rotary base is sleeved onto the bullet barrel and the pressure assembly, an eccentric adjustment portion is provided on an inner surface of the rotary base and located corresponding to an upper end of the pressure assembly, rotating the rotary base can make the eccentric adjustment portion press the pressure assembly, and the pressure assembly presses the bullet barrel to make the protruding blocks move downward toward the slot of the inner barrel.

Preferably, a fixing member is disposed at the rear end of the inner barrel and fixed around an outer surface of the bullet barrel, and includes an annular portion and a connecting portion which are formed at two ends of the fixing member, respectively, an engaging portion is formed between the annular portion and the connecting portion, an inserting hole is formed in the engaging portion for insertion of the pressure assembly, and the rotary base is sleeved onto the engaging portion.

Preferably, an engaging assembly is provided at the rear end of the inner barrel, and includes an inserting rod and a swingable link rod which are pivoted to each other, a plurality of engaging holes is formed around the annular portion, when the link rod swings, the inserting rod will move forward to engage in one of the engaging holes, so as to fix the inner barrel.

Preferably, the eccentric weight is located at the rear end of the outer barrel, the connecting portion is connected to the eccentric weight, an inner liner is fixed on the inner surface of the rear end of the outer barrel, and the rotary member is disposed between the inner liner and the inner barrel.

Preferably, the eccentric weight is provided at the front end thereof with an inserting portion which is to be inserted in the inner liner, and the rotary member is located between the inner liner and the inserting portion.

The main object of the present invention is to provided an improved gun barrel for a toy gun, wherein the inner barrel is pivotably disposed in the outer barrel, and the inner barrel is provided with the eccentric weight, so that even when the gun is held in an inclined position, the inner barrel still can return to a non-inclined position to ensure the ballistic trajectory stability while improving the hit rate. Besides, the inner barrel can still be adjusted to be fixed to the outer barrel in a fixed manner to facilitate ballistic trajectory adjustment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION OF THE PREFERRED EMBODIMENT

The present invention will be clearer from the following description when viewed together with the accompanying drawings, which show, for purpose of illustrations only, the preferred embodiment in accordance with the present invention.

Figure 1:
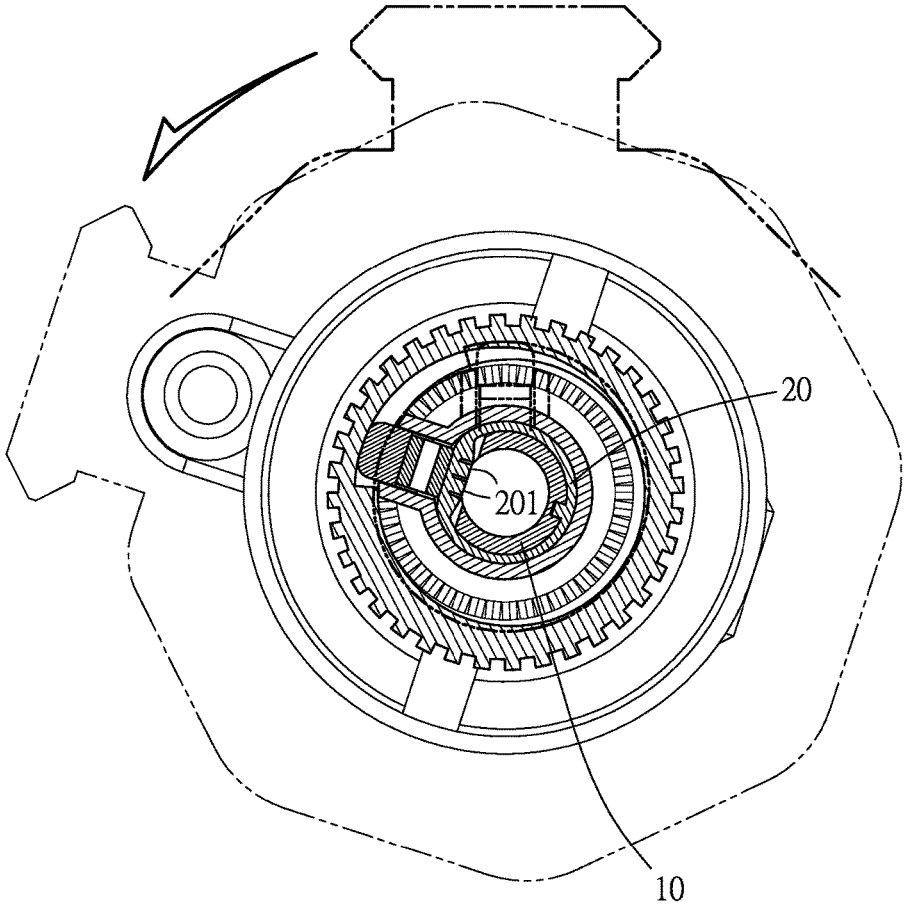
FIG. 1 (PRIOR ART)
FIG. 1 is a cross sectional view of the inner barrel of the gun barrel showing that the conventional toy gun is held in an inclined position.
Figure 2:
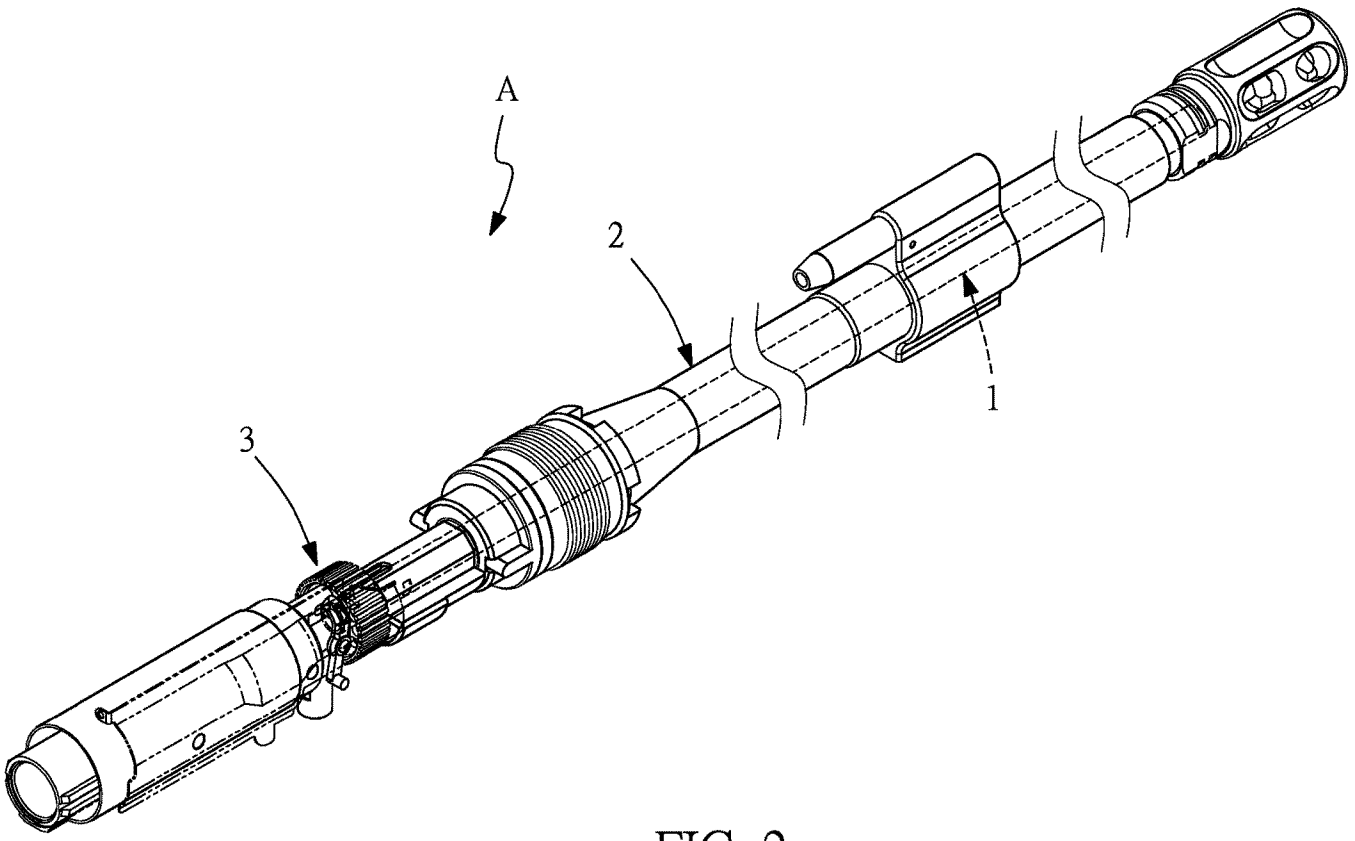
FIG. 2 is an assembly view of the gun barrel unit for a toy gun in accordance with the present invention.
Figure 3:
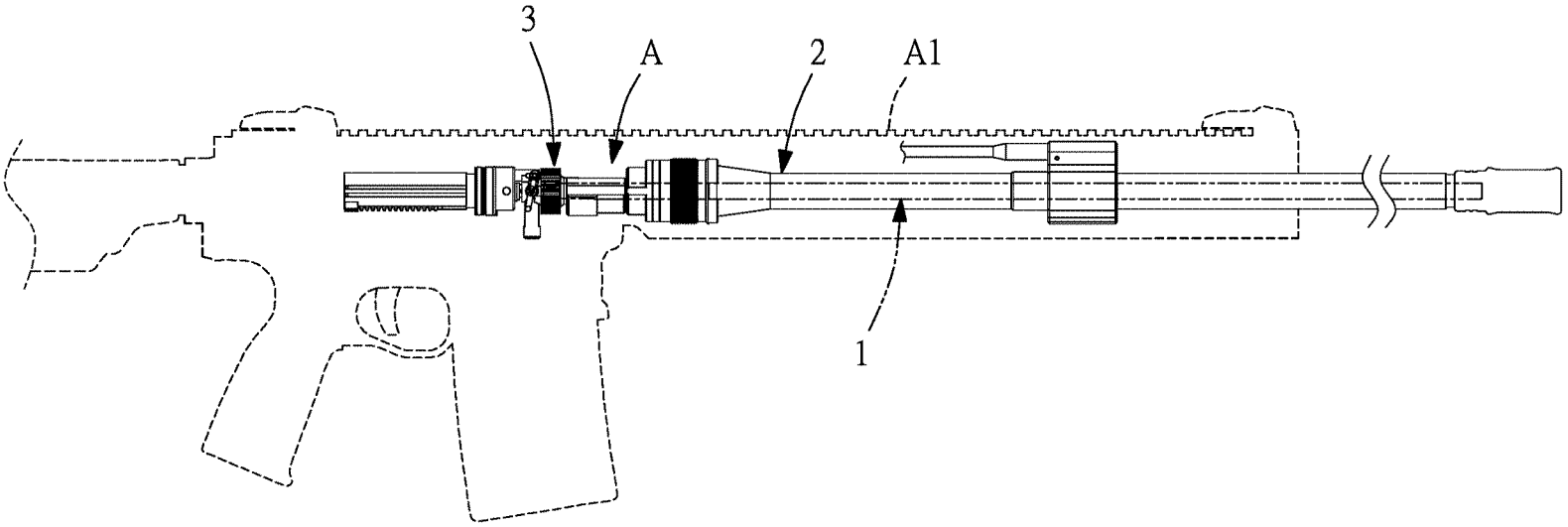
FIG. 3 is a plan view of the present invention showing that the gun barrel unit is assembled onto the toy gun.

Referring to FIGS. 2 and 3, a gun barrel unit A for a toy gun in accordance with the present invention includes: an inner barrel 1, an outer barrel 2 and a ballistic adjustment device 3.

Figure 4:
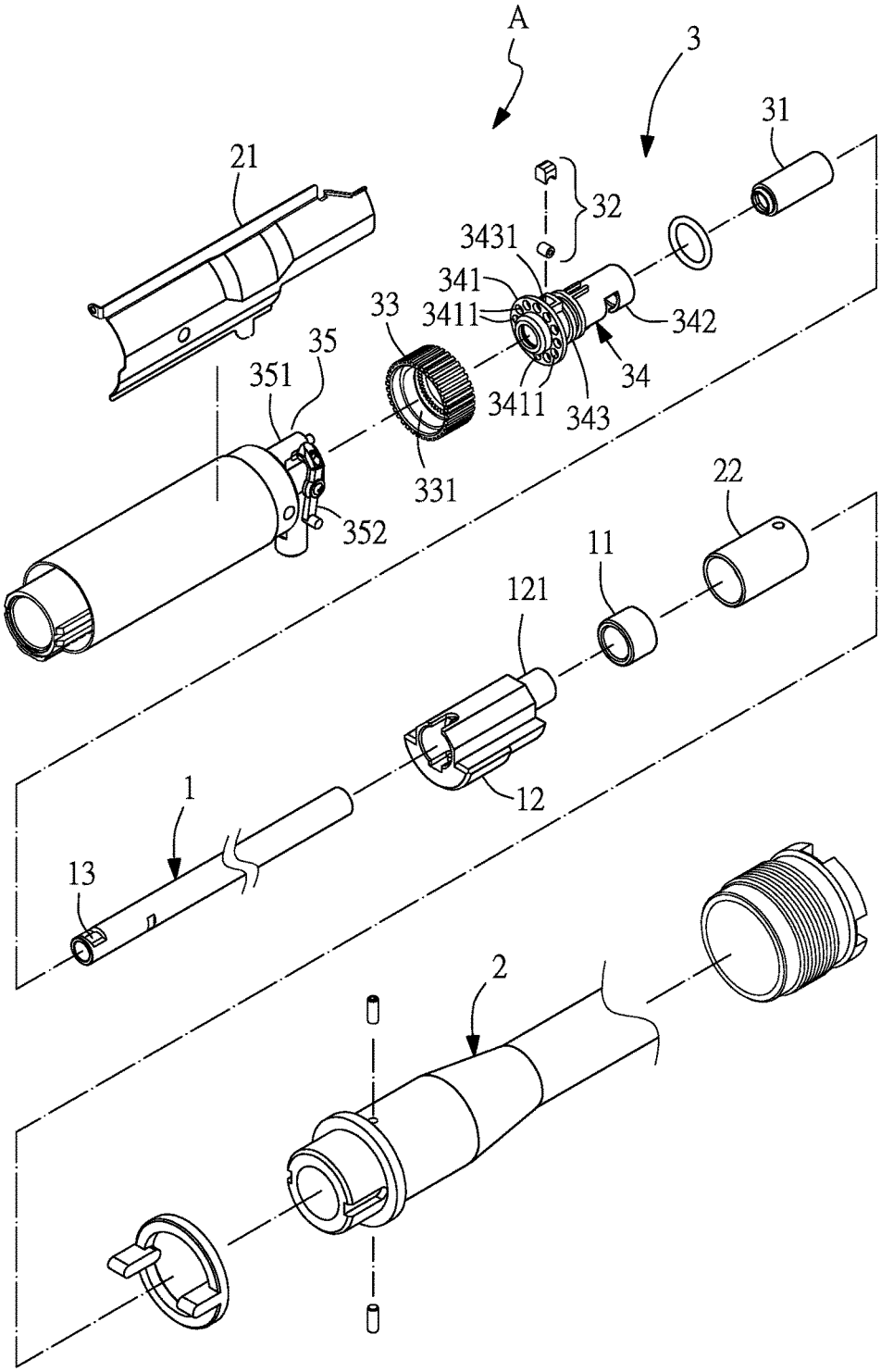
FIG. 4 is an exploded view of the gun barrel unit for a toy gun in accordance with the present invention.
Figure 5:
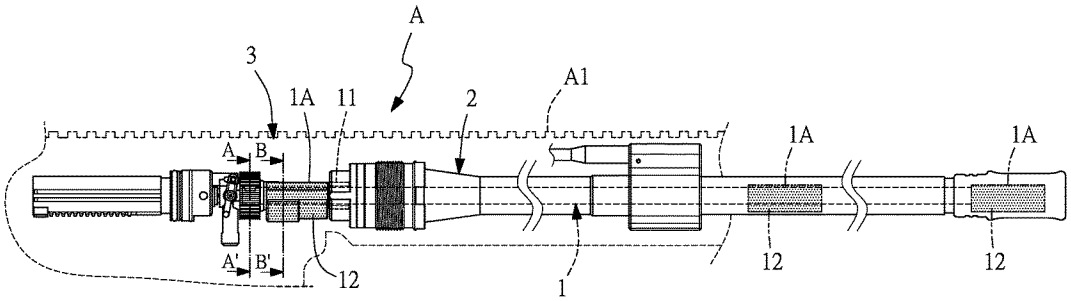
FIG. 5 is an illustrative view of the present invention showing that the eccentric weight is disposed in the inner barrel.
Figure 6:
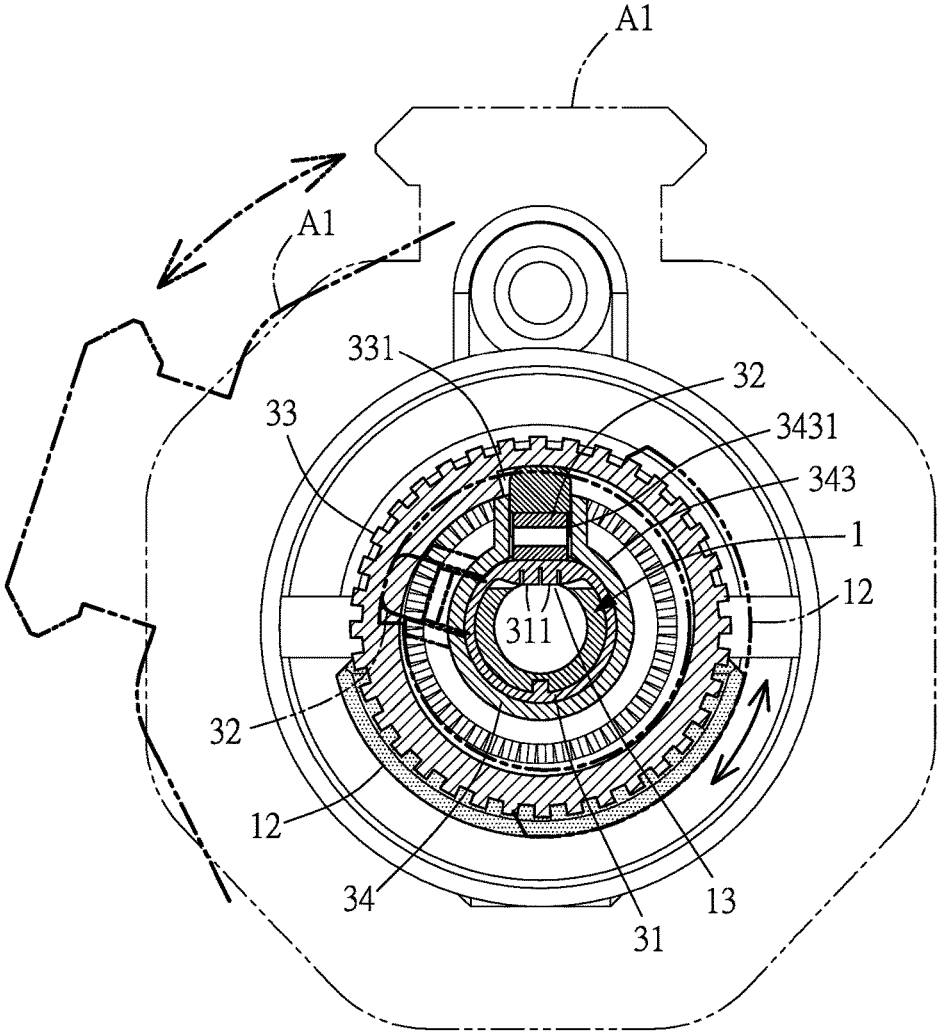
FIG. 6 is a cross sectional view taken along the line A-A' of FIG. 5.
Figure 7:
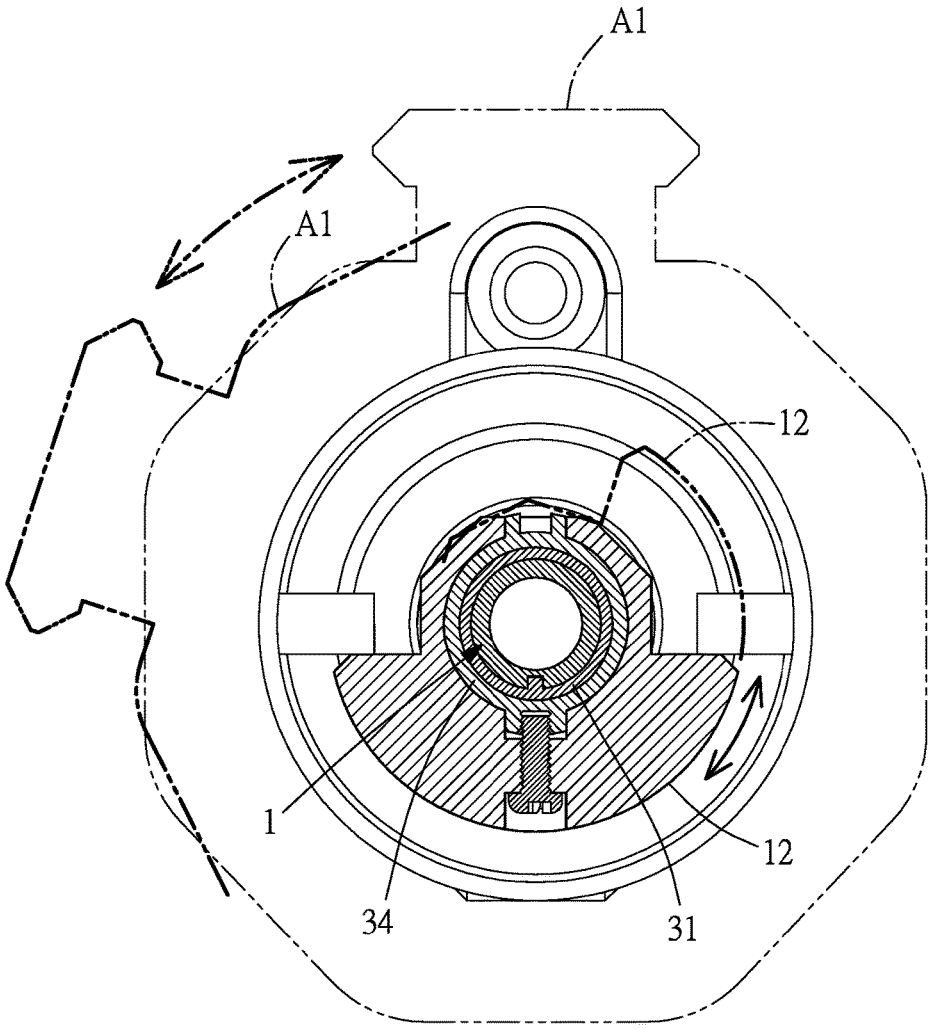
FIG. 7 is a cross sectional view taken along the line B-B' of FIG. 5.

The inner barrel 1, as shown in FIGS. 4 and 5, is inserted in the outer barrel 2. Provided between the inner and outer barrels 1, 2 is a rotary member 11 (which can be a bearing especially in mechanical field) to allow for rotation of the inner barrel 1 with respect to the outer barrel 2. At least one eccentric weight 12 is fixed to the inner barrel 1 at at least one connecting position 1A (as shown in FIG. 5) which can be at the front, middle or rear of the inner barrel 1 (as shown in FIG. 5). Please referring to FIGS. 6 and 7, FIG. 6 is a cross sectional view taken along the line A-A' of FIG. 5, and FIG. 7 is a cross sectional view taken along the line B-B' of FIG. 5, wherein the inner barrel 1 is axially rotatable. With the arrangement of the eccentric weight 12, the inner barrel 1 can be maintained in a noninclined position even when the gun A1 is held in an inclined condition. Besides, a slot 13 is provided at the upper surface of the rear end of the inner barrel 1 (as shown in FIGS. 4 and 6).

Figure 8:
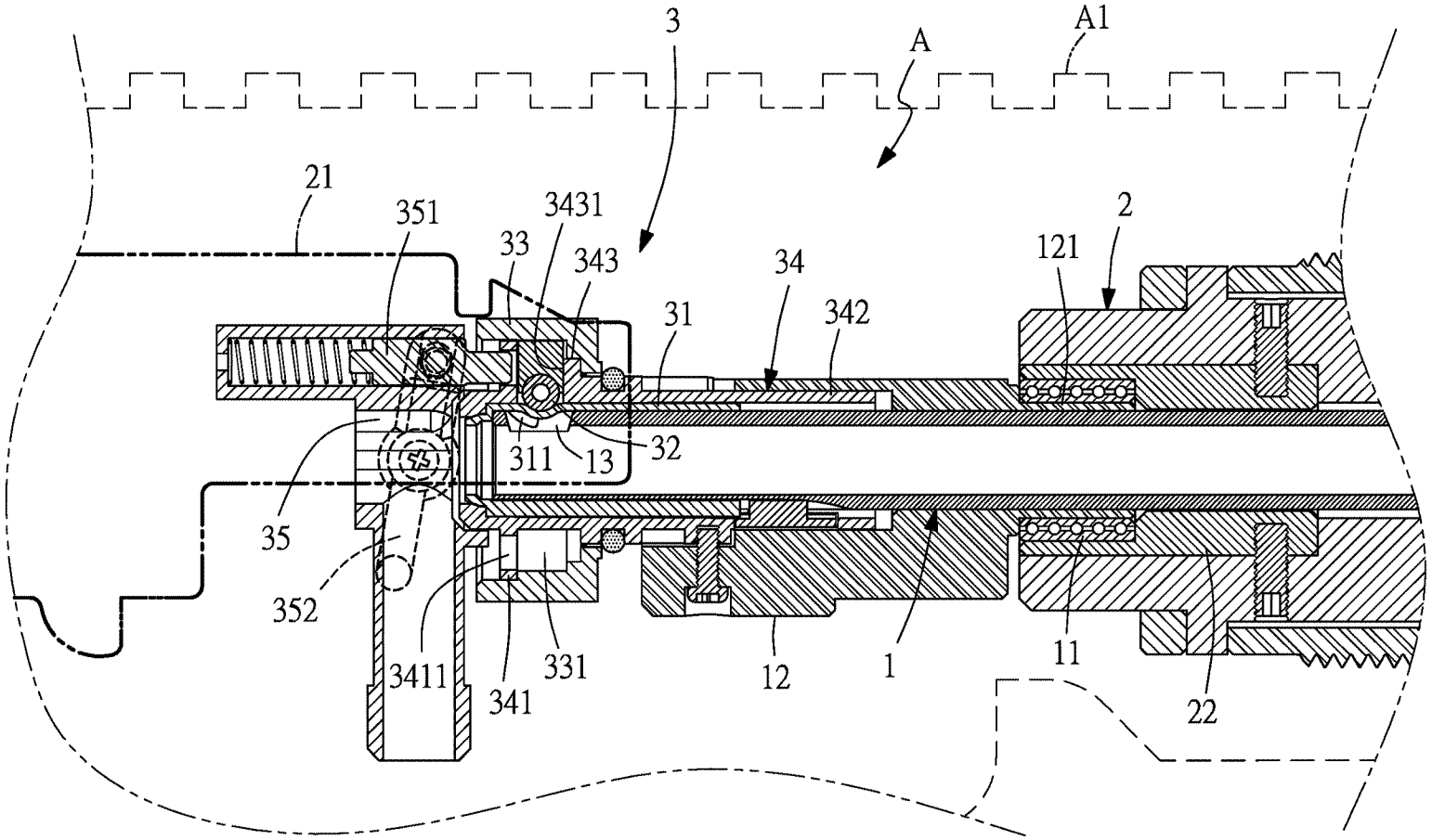
FIG. 8 is a cross sectional view of a part of the gun barrel unit for a toy gun in accordance with the present invention.

The outer barrel 2, as shown in FIGS. 4 and 8, is fixed to the gun A1. A bolt device 21 is provided at the outer side of the rear end of the outer barrel 2, and an inner liner 22 is fixed on the inner surface of the rear end of the outer barrel 2. The rotary member 11 is disposed between the inner liner 22 and the inner barrel 1, and the eccentric weight 12 is located at the rear end of the outer barrel 2. The eccentric weight 12 is located at the rear end of the outer barrel 2, and provided at the front end thereof with an inserting portion 121 which is to be inserted in the inner liner 22. The rotary member 11 is located between the inner liner 22 and the inserting portion 121.

Figure 9:
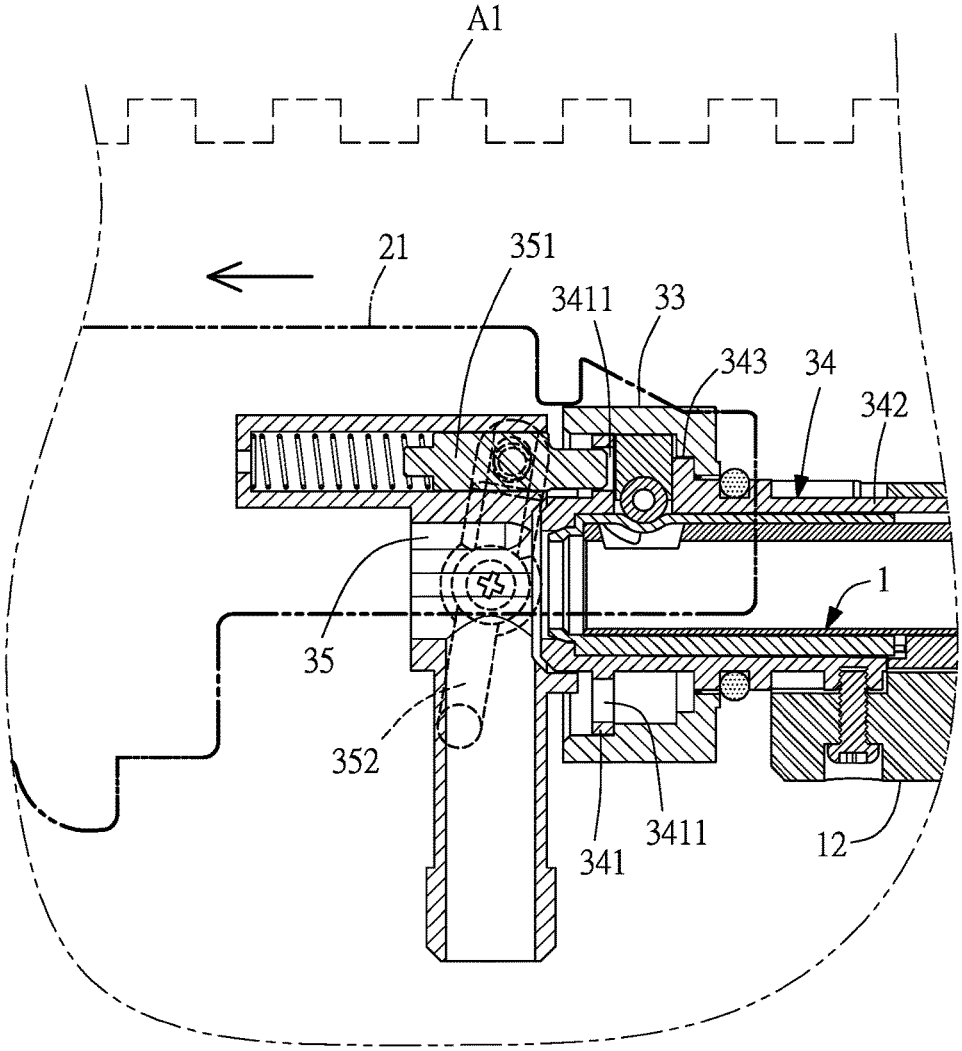
FIG. 9 is a cross sectional view of a part of the gun barrel unit for a toy gun in accordance with the present invention, wherein the bolt device moved backward.
Figure 10:
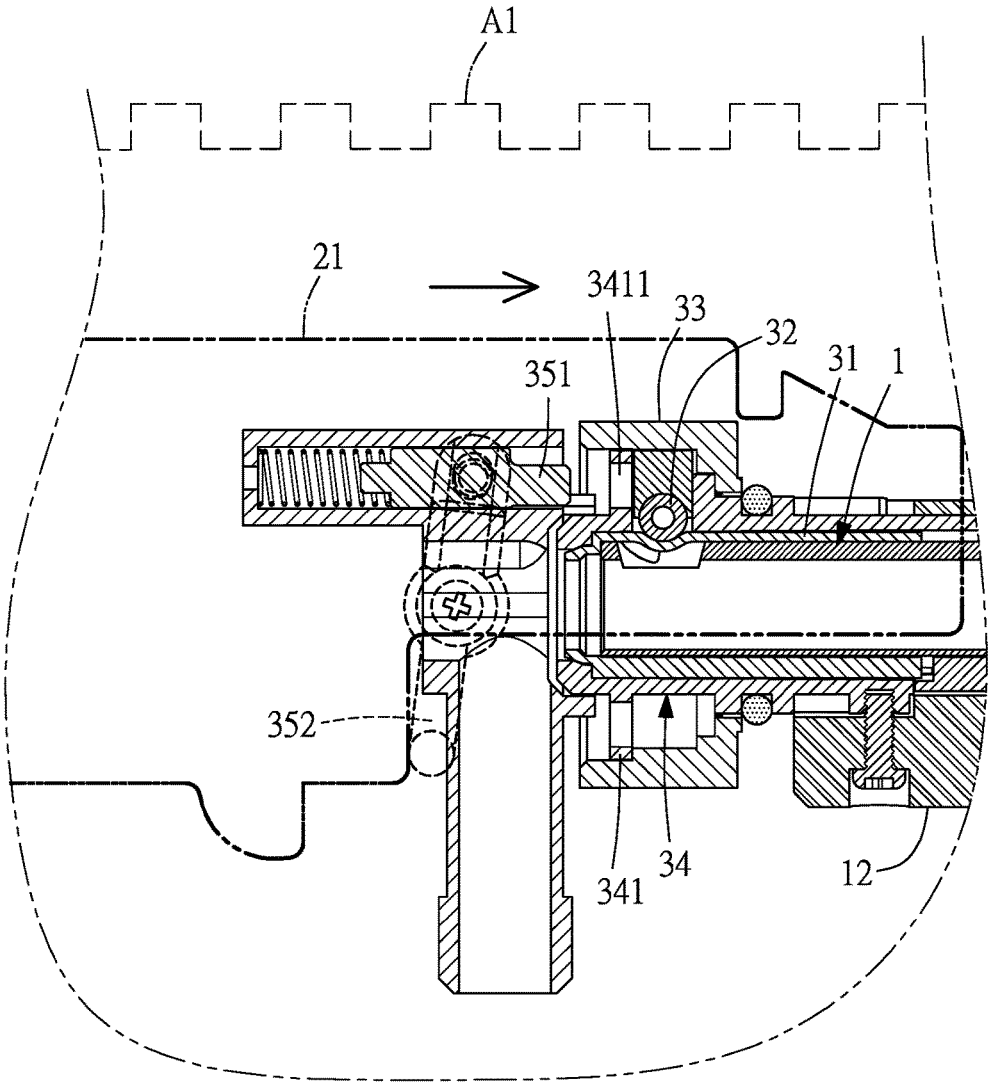
FIG. 10 is a cross sectional view of a part of the gun barrel unit for a toy gun in accordance with the present invention, wherein the bolt device moved forward.

The ballistic adjustment device 3 includes a bullet barrel 31, a pressure assembly 32, a rotary base 33, a fixing member 34 and an engaging assembly 35. The bullet barrel 31 is an elastic member (made of rubber or plastic) sleeved onto the rear end of the inner barrel 1. At least two protruding blocks 311 (there are four protruding blocks as shown in FIG. 6) are formed on the inner surface of the rear end of the bullet barrel 31 and located corresponding to the slot 13 of the inner barrel 1. The protruding blocks 311 are arc-shaped. The pressure assembly 32 is located on the rear end of the bullet barrel 31 to press the protruding blocks 311. The rotary base 33 is sleeved onto the bullet barrel 31 and the pressure assembly 32, and provided on the inner surface thereof with an eccentric adjustment portion 331 which is located corresponding to the upper end of the pressure assembly 32. Rotating the rotary base 33 can make the eccentric adjustment portion 331 press or not press the pressure assembly 32. When the pressure assembly 32 presses the bullet barrel 31, the protruding blocks 311 will move downward toward the slot 13 of the inner barrel 1, and thus the ballistic trajectory can be adjusted. The fixing member 34 is fixed around the outer surface of the bullet barrel 31, and includes an annular portion 341 and a connecting portion 342 formed at two ends of the fixing member 34, respectively. The fixing member 34 further includes an engaging portion 343 between the annular portion 341 and the connecting portion 342. In the engaging portion 343 is formed an inserting hole 3431 for insertion of the pressure assembly 32. The rotary base 33 is sleeved onto the engaging portion 343, and the connecting portion 342 is connected to the eccentric weight 12. The annular portion 341 is annularly provided with a plurality of engaging holes 3411. The engaging assembly 35 is located at the rear end of the inner barrel 1, and includes an inserting rod 351 and a swingable link rod 352 which are pivoted to each other. The inserting rod 351 provides forward elastic force. When the bolt device 21 does not move forward, the link rod 352 swings in one direction, at this moment, the inserting rod 351 can move forward to engage in one of the engaging holes 3411, so that the inner barrel 1 can be fixed (as shown in FIG. 9) to facilitate the adjustment of ballistic trajectory. When moving forward, the bolt device 21 will push the lower portion of the link rod 352 (as shown in FIG. 10). When the link rod 352 moves in another direction, the inserting rod 351 will move backward and will be released from the engaging holes 3411, and thus the inner barrel 1 is pivotable again.

When in use, the bolt device 21 moves forward to push the lower portion of the link rod 352 (as shown in FIG. 10) to make the inserting rod 351 move backward to release from the engaging holes 3411. At this moment, the inner barrel 1 is axially pivotable again, and the gun is in a ready to fire position. Even when the gun A1 is held in an inclined position due to the restriction of location and user's posture, the inner barrel 1 will be returned to a non-inclined manner by the eccentric weight 12 (as shown in FIGS. 6 and 7) to make sure the protruding blocks 311 of the bullet barrel 31 is maintained in a non-inclined position, namely to make sure the position of the friction of the bullet is in the non-inclined position, which consequently ensures the ballistic trajectory stability and the hit rate, and this is the object of the present invention. Besides, to adjust the ballistic trajectory, the inner barrel 1 must be positioned. At this moment, the bolt device 21 must move backward (as shown in FIG. 9) to make the inserting rod 351 move forward and engage in one of the engaging holes 3411, so that the inner barrel 1 is fixed (as shown in FIG. 9), and the rotary base 33 is rotatable to facilitate the adjustment of ballistic trajectory.

As mentioned above, the inner barrel 1 is pivotably disposed in the outer barrel 2, and the inner barrel 1 is provided with the eccentric weight 12, so that even when the gun A1 is held in an inclined position, the inner barrel 1 still can return to a non-inclined manner to make sure the protruding blocks 311 of the bullet barrel 31 is maintained in a non-inclined position, namely to make sure the position of the friction of the bullet is in a non-inclined upper position, which consequently ensures the ballistic trajectory stability while improving the hit rate. Besides, the inner barrel 1 can still be adjusted to be fixed to the outer barrel 2 in a fixed manner, and the ballistic trajectory is still adjustable, which therefore solves the problems of the aforementioned conventional gun barrel structure.

While we have shown and described various embodiments in accordance with the present invention, it is clear to those skilled in the art that further embodiments may be made without departing from the scope of the present invention.

What is claimed is:

1. A gun barrel unit for a toy gun comprising:

an inner barrel and an outer barrel, the inner barrel being axially inserted in the outer barrel, wherein at least one rotary member is provided between the inner and outer barrels to allow for rotation of the inner barrel with respect to the outer barrel, and at least one eccentric weight is fixed to the inner barrel and located at at least one connecting position, wherein a ballistic adjustment device is disposed at a rear end of the inner barrel, a slot is provided at an upper surface of the rear end of the inner barrel, the ballistic adjustment device at least includes a bullet barrel, a pressure assembly, and a rotary base, wherein the bullet barrel is an elastic member sleeved onto the rear end of the inner barrel, wherein at least two protruding blocks are formed on an inner surface of the rear end of the bullet barrel and located corresponding to the slot of the inner barrel, wherein the pressure assembly is located on the rear end of the bullet barrel to press the protruding blocks, wherein the rotary base is sleeved onto the bullet barrel and the pressure assembly, wherein an eccentric adjustment portion is provided on an inner surface of the rotary base and located corresponding to an upper end of the pressure assembly, wherein rotating the rotary base makes the eccentric adjustment portion press the pressure assembly, and the pressure assembly presses the bullet barrel to make the protruding blocks move downward toward the slot of the inner barrel.

2. The gun barrel unit for the toy gun as claimed in claim 1, wherein a fixing member is disposed at the rear end of the inner barrel and fixed around an outer surface of the bullet barrel, and includes an annular portion and a second connecting portion which are formed at two ends of the fixing member, respectively, wherein an engaging portion is formed between the annular portion and the second connecting portion, wherein an inserting hole is formed in the engaging portion for insertion of the pressure assembly, and the rotary base is sleeved onto the engaging portion.

3. The gun barrel unit for the toy gun as claimed in claim 2, wherein an engaging assembly is provided at the rear end of the inner barrel, and includes an inserting rod and a swingable link rod which are pivoted to each other, wherein a plurality of engaging holes is formed around the annular portion, wherein when the link rod swings, the inserting rod moves forward to engage in one of the engaging holes, so as to fix the inner barrel.

4. The gun barrel unit for the toy gun as claimed in claim 3, wherein the eccentric weight is located at the rear end of the outer barrel, wherein the connecting portion is connected to the eccentric weight, wherein an inner liner is fixed on the inner surface of the rear end of the outer barrel, and the rotary member is disposed between the inner liner and the inner barrel.

5. The gun barrel unit for the toy gun as claimed in claim 4, wherein the eccentric weight is provided at the front end thereof with an inserting portion which is to be inserted in the inner liner, and the rotary member is located between the inner liner and the inserting portion.

* * * * *